US006697589B1

(12) United States Patent
Dunning et al.

(10) Patent No.: US 6,697,589 B1
(45) Date of Patent: Feb. 24, 2004

(54) FUSER LATCH SYSTEM

(75) Inventors: Gordon Robert Dunning, Versailles; Paul Douglas Horrall; Edward Alan Rush, both of Lexington, all of KY (US)

(73) Assignee: Lexmark International, Inc., Lexington, KY (US)

( * ) Notice: Subject to any disclaimer, the term of this patent is extended or adjusted under 35 U.S.C. 154(b) by 88 days.

(21) Appl. No.: 09/804,443

(22) Filed: Mar. 12, 2001

(51) Int. Cl.[7] ..... G03G 15/00; G03G 15/16
(52) U.S. Cl. ..... 399/122; 399/107
(58) Field of Search ..... 292/217; 399/107, 399/116, 117, 121, 122, 124, 123, 125

(56) References Cited

U.S. PATENT DOCUMENTS

| | | | | |
|---|---|---|---|---|
| 458,180 | A | | 8/1891 | Lyons |
| 1,427,253 | A | | 8/1922 | Appleby |
| 2,337,948 | A | | 12/1943 | Vani |
| 2,516,336 | A | | 7/1950 | Olander |
| 3,598,045 | A | * | 8/1971 | Miller ..... 292/217 |
| 3,984,135 | A | | 10/1976 | Dathe et al. |
| 4,355,225 | A | | 10/1982 | Marsh |
| 4,563,078 | A | | 1/1986 | Fantuzzo et al. |
| 4,791,448 | A | | 12/1988 | Kawashima et al. |
| 4,949,399 | A | | 8/1990 | Williams et al. |
| 4,965,640 | A | | 10/1990 | Watarai et al. |
| 5,021,825 | A | | 6/1991 | Niki |
| 5,028,966 | A | | 7/1991 | Kozuka et al. |
| 5,045,887 | A | | 9/1991 | Nakamura |
| 5,049,945 | A | | 9/1991 | Fukano et al. |
| 5,105,221 | A | | 4/1992 | Takahashi et al. |
| 5,105,228 | A | | 4/1992 | Kato |
| 5,191,380 | A | | 3/1993 | Hoover et al. |
| 5,201,852 | A | | 4/1993 | Ogoshi |
| 5,206,682 | A | | 4/1993 | Yamada et al. |
| 5,237,340 | A | | 8/1993 | Nelson |
| 5,305,065 | A | | 4/1994 | Hoover et al. |
| 5,436,698 | A | | 7/1995 | Ohtaka |
| 5,576,929 | A | | 11/1996 | Uchiyama et al. |
| 5,583,612 | A | | 12/1996 | Schell et al. |
| 5,621,451 | A | | 4/1997 | Sugiura et al. |
| 5,729,798 | A | | 3/1998 | Yasui et al. |
| 5,761,597 | A | | 6/1998 | Smith et al. |
| 5,787,319 | A | | 7/1998 | Tomatsu |
| 5,787,322 | A | | 7/1998 | Sass et al. |
| 5,802,426 | A | | 9/1998 | Miyazaki et al. |
| 5,819,139 | A | | 10/1998 | Harlan et al. |
| 5,822,655 | A | | 10/1998 | Ikeda |
| 5,840,003 | A | | 11/1998 | Meetze, Jr. et al. |
| 5,842,091 | A | | 11/1998 | Nakano |
| 5,848,331 | A | | 12/1998 | Fromm |
| 5,884,123 | A | | 3/1999 | Stickney et al. |
| 5,926,671 | A | | 7/1999 | Leibman |
| 5,956,547 | A | | 9/1999 | Kamei et al. |

* cited by examiner

*Primary Examiner*—Hoang Ngo
(74) *Attorney, Agent, or Firm*—John A. Brady; Taylor & Aust, PC

(57) ABSTRACT

A fuser latch system suitable for a customer replaceable fuser unit. Front holders include datum receivers on a base machine frame and datums on the fuser frame. Rear latches include retainers connected to the base machine frame, and axially translatable and rotatable shafts connected to the fuser frame. An end of the shaft is received in a retainer upon axial translation of the shaft, and locked in place upon rotation of the shaft. The rear latches bias the fuser frame for proper gear mesh and paper path alignment.

30 Claims, 10 Drawing Sheets

FUSER LATCH SYSTEM

BACKGROUND OF THE INVENTION

1. Field of the Invention

The present invention relates to electrophotographic imaging apparatus, and, more particularly, to a latch mechanism securing the fuser unit in the apparatus.

2. Description of the Related Art

In the electrophotographic process commonly used in printers and the like, an electrostatic image is created on photosensitive material such as a belt or a roll. Tiny marking particles, called toner, are applied to the electrostatic image on the photosensitive material. In a monochrome printer, toner is applied in a single station, as only black toner is used. However, in a color printer, separate application stations are provided for black, magenta, yellow and cyan toners. The toner image is then transferred to the desired media, which may include paper, cardstock, envelopes, transparencies or the like. The applied toner image is not, however, permanent until the toner particles are fixed to the receiving media.

To permanently adhere the toner to the media, the media with the toner image thereon is passed through a fuser unit, in which heat and pressure are applied to the toner image. The heat causes constituents of the toner to flow into the pores or interstices between fibers of the media. Pressure in the fuser promotes settling of the toner constituents into these voids. As the sheet exits the fuser, the toner is cooled and solidified, adhering the image to the media.

A commonly used fuser assembly is a roll fuser, which includes two rolls nipped together, with at least one of the rolls being internally heated. The non-heated roll, or back-up roll, is urged against the hot roll, to form a fuser nip through which the media passes.

As a result of the conditions present in the fuser, including high temperature and high pressure, components of the fuser system may have a life span shorter than other machine components, and shorter than the expected life of the base machine. Therefore, it is expected and required that the fuser or various components thereof will be replaced periodically during the useful life span of the machine. To ease replacement of the expired fuser components, various components are unitized, that is the replaceable components are included in a single unitary assembly having a frame and mounting structures compatible with receiving assemblies and structures in the base machine. When replacement is required, locking components are released, the expired fuser unit is removed, a replacement fresh fuser unit is installed and the locking components are re-engaged.

In past fuser designs, it is known for replacement of the fuser to be a service event performed by trained maintenance personnel. However, with more refined unitization of components, and the standardization of life expectancy for various components of the fuser unit, it is desirable that fuser units be designed to be replaced by the customer. Such units are referred to as a CRU or customer replaceable unit. In designing a CRU, it is necessary that the unit be removed and inserted into the base machine easily and accurately, and that it be sufficiently robust to take reasonable amounts of abuse from an untrained installer. Further, it is essential that the CRU be accurately and easily positioned relative to mating components of the base machine when latched into the base machine. Mating drive gears, paper guides and the like must relate accurately and precisely, to minimize misalignment and allow the machine to perform reliably. Even slightly misaligned gears can wear significantly in a short period of time, and fail prematurely. Misaligned paper paths can cause paper jams.

Although computer equipment, such as a printer, is packaged for shipment in a strong shipping container, with packing material limiting movement of the equipment in the container, the containers can be dropped, bumped or jostled during handling and delivery. Even though the printer housing is stabilized within the container, if the container is dropped, a shock can be transmitted to the internal components of the printer. In new office layouts, cubicles, workstations and the like are frequently moved and rearranged. Computer and printing equipment also must be portable and capable of rearrangement and moving. Printers have become smaller, lighter and more easily and conveniently moved. However, equipment may be moved by untrained personnel, even the user, and during a move a printer can be jarred while being transported from one location to another. Therefore, it is essential that a fuser CRU be adequately secured in the housing to withstand a relatively jarring event, such as if the printer is bumped or dropped.

Known latching schemes for fuser CRUs include conventional screws, thumb screws, levers and ninety degree latches. While most of these latching schemes work adequately to retain the fuser in the machine housing, each has drawbacks in design or use. The major drawback of a plain screw latching scheme to retain the fuser in the housing is that the customer is required to use a tool for detaching the expired unit and attaching the replacement unit to the machine. For any customer performed service, it is desirable to eliminate the need for tools, as appropriate tools may not be conveniently available and untrained personnel performing the service may not be comfortable or skilled in using the required tool.

A drawback to the use of plain screws and thumb screws in the latching schemes for fuser CRUs is the possibility of stripping or damaging the threads during use. The untrained user may over-tighten either a conventional screw or a thumb screw, particularly if the user selects a powered driver for operating the screw. Further, screw assemblies often include the use of a metal insert in a plastic part, and insertion of the screw may result in detachment of the metal and plastic components. If threads or inserts are damaged, the fuser will not be located or restrained adequately. Further, if conventional or thumb screws in different parts of the CRU are not similarly tightened, the fuser may skew and bind during insertion or operation. For these and other reasons, neither conventional screws nor thumb screws are desirable latching schemes for fuser CRUs.

Both levers and ninety degree latches are more intuitive and less prone to assembly problems than conventional screws or thumb screws. A drawback to the use of levers and ninety degree latches in latching schemes for fuser CRUs is the size and cost of the lever system or ninety degree latch. To achieve adequate mechanical advantage for levers and latches, to minimize the effort required to perform the latching process, the levers and latches must have a reasonably long length from a pivot or fulcrum point to the force application position. The length or size of the lever or latch systems often take valuable space in the machine, working against the desire to make printers smaller and more compact. Further, if the latch mechanism is to restrain the fuser during a drop event, the strength requirements for the lever or latch mechanism can become relatively expensive. To reduce cost, it is known to use plastic latches in combination with metal tabs on the machine frame to restrain the fuser.

However, drawbacks to this solution include the requirement that the customer lift the relatively heavy CRU fuser over the tabs in the machine in order to remove the fuser, and to install the new fuser, which can be awkward and non-intuitive. The user can be confused as to how to properly perform the operation. The need to consult a user manual is undesirable, as the user manual may become separated from the machine, and many users will not willingly take the time to consult written instructions. Further, the tolerances from the formed tab on the machine base to the fusers mating components are substantial, making it difficult to control the fuser final resting position.

Therefore, what is needed is a fuser latch system that is intuitive and easy to operate, both for disengagement and reengagement of fuser CRUs, and which accurately positions the CRU for use while adequately securing the CRU to withstand significant jarring. What is further needed is a fuser latch system which is reliable and inexpensive to manufacture.

SUMMARY OF THE INVENTION

The present invention provides a fuser unit latch system suitable for securing a customer replaceable fuser in a base machine, such as a printer.

The invention comprises, in one form thereof, a latch system for a fuser unit in a base machine. The latch system includes a datum receiver provided on the base machine, and a retainer connected to the base machine. The retainer has an enclosed space, with a lateral opening thereto. A frame carries the fuser unit, and has a datum configured to engage said receiver. A shaft is connected to the frame and is rotatable and axially translatable relative to the frame. An end of the shaft is adapted to be received in the enclosed space upon axial translation of the shaft. A handle connected to the shaft is movable between locked and unlocked positions upon rotation of the shaft, and has means for securing the handle in the locked position.

The invention comprises, in another form thereof, a latch system for a fuser unit in a base machine. The latch system includes a frame carrying the fuser unit, the frame having a front side, a rear side and first and second lateral sides. A first retainer is connected to the base machine, near the first lateral side of the frame, the first retainer having a first enclosed space with a lateral opening thereto. A second retainer is connected to the base machine near the second lateral side, the second retainer having a second enclosed space with a lateral opening thereto. The first and second retainers are positioned in the base machine near the rear side. A first shaft is connected to the frame near the first lateral side, and a second shaft connected to the frame near the second lateral side. The first shaft and the second shaft are each rotatable and axially translatable relative to the frame. A first end of the first shaft is adapted to be received in the first enclosed space by axial translation of the first shaft. A second end of the second shaft is adapted to be received in the second enclosed space by axial translation of the second shaft. A first handle connected to the first shaft and is movable between locked and unlocked positions, the first handle having first locking means for securing the first handle in the locked position. A second handle connected to the second shaft and is movable between locked and unlocked positions, the second handle having second locking means for securing the second handle in the locked position.

The invention comprises, in still another form thereof, a latch system for a fuser unit in a base machine, including a frame for the fuser unit. Mounting datums on a front side of the frame are provided for securing the front side of the fuser unit. Datum receivers in the base machine engage the datums and release the datums by movement of the frame. A first latch mechanism and a second latch mechanism are disposed at a rear side of the frame. The first latch mechanism is disposed near a first lateral side of the frame and the second latch mechanism disposed near a second lateral side of the frame. The first latch mechanism has a first eccentric body, and the second latch mechanism has a second eccentric body. A first retainer and a second retainer in the base machine are configured and arranged for receiving the first eccentric body and the second eccentric body, respectively.

The invention comprises, in a further form thereof, a method for securing a fuser in a base machine including steps of providing datums on a forward side of the fuser and datum receivers in the base machine for engaging the datums; sliding the fuser and engaging the datums and receivers; providing a first latch mechanism and a second latch mechanism, each having a fuser component and a base machine component; sliding each of the fuser components axially outwardly; inserting the fuser components into the base machine components; and rotating the fuser components in the base machine components.

The invention comprises, in a still further form thereof, a latch system for securing a first frame in a second frame. The latch system comprises a holder having a datum on one of the frames and a datum receiver on the other of the frames. The datum and the receiver are configured and arranged for the receiver to engage the datum by sliding one toward the other. A latch has a retainer on one of the frames and an axially translatable shaft on the other of the frames. The shaft has a body receivable in the retainer. The holder and the latch are disposed on opposite sides of the frames.

An advantage of the present invention is that the latch system is easy to understand and simple to operate, making the latch system suitable for use in a customer replaceable fuser unit.

Another advantage is that the latch system is compact, requiring minimal space in a printer or the like employing the latch system on a fuser CRU, and the latch system is less expensive to build than more complicated systems, thereby reducing the expense for a CRU.

Yet another advantage is that the latch system holds the fuser unit securely in position, and can withstand some jarring, such as if a printer having a fuser retained by the latch system were bumped or dropped, thereby reducing the potential for hardware damage during such an event.

A further advantage is that the latch system properly aligns the fuser unit in the base machine and properly biases the fuser against a given reference surface, thereby controlling gear mesh and orienting paper paths to reduce the potential for paper jams and premature gear wearing resulting from misaligned machine components.

A still further advantage of the present invention is that operation of the latch system is intuitive, even to unskilled and untrained individuals, and the latch system is reliable.

BRIEF DESCRIPTION OF THE DRAWINGS

The above-mentioned and other features and advantages of this invention, and the manner of attaining them, will become more apparent and the invention will be better understood by reference to the following description of (an) embodiment(s) of the invention taken in conjunction with the accompanying drawing(s), wherein.

Corresponding reference characters indicate corresponding parts throughout the several views. The exemplifications set out herein illustrate one preferred embodiment of the invention, in one form, and such exemplifications are not to be construed as limiting the scope of the invention in any manner.

DETAILED DESCRIPTION OF THE INVENTION

Figure 1:
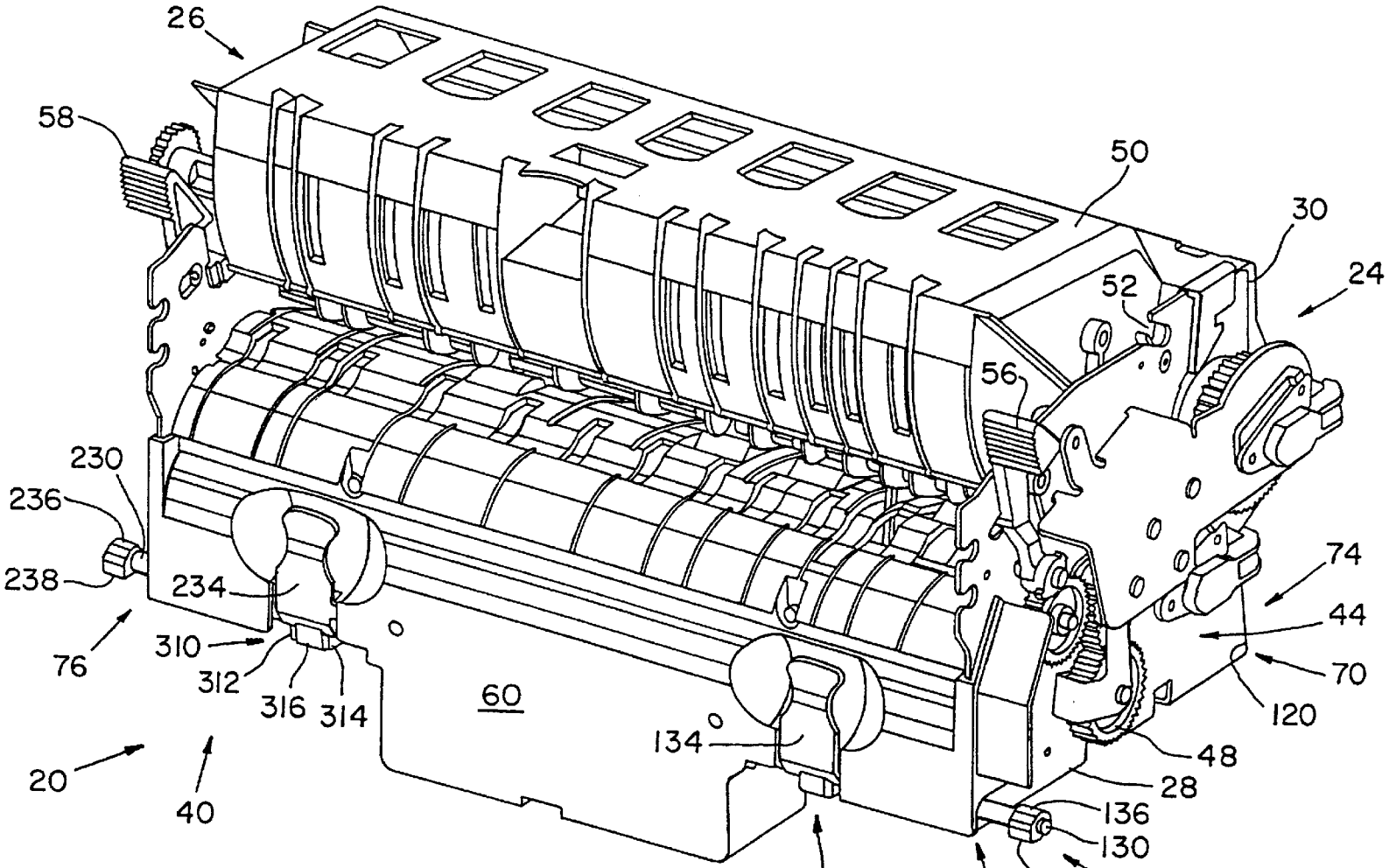
FIG. 1 is a perspective view of a fuser unit having a fuser latch system in accordance with the present invention.

Referring now to the drawings, and particularly to FIG. 1, there is shown a fuser assembly 20 in which a fuser latch system 22 of the present invention is advantageously employed. Fuser assembly 20 is, for example, a fuser from a laser printer, or the like. However, it should be understood that the present latch system may be used advantageously for other types of fuser units in other types of printers, and in other types of apparatuses wherein it is desirable to secure a modular unit within a base structure. Fuser 20, as shown, is merely one example of such an apparatus, and is not intended as a limitation on the claims to follow.

Figure 4:
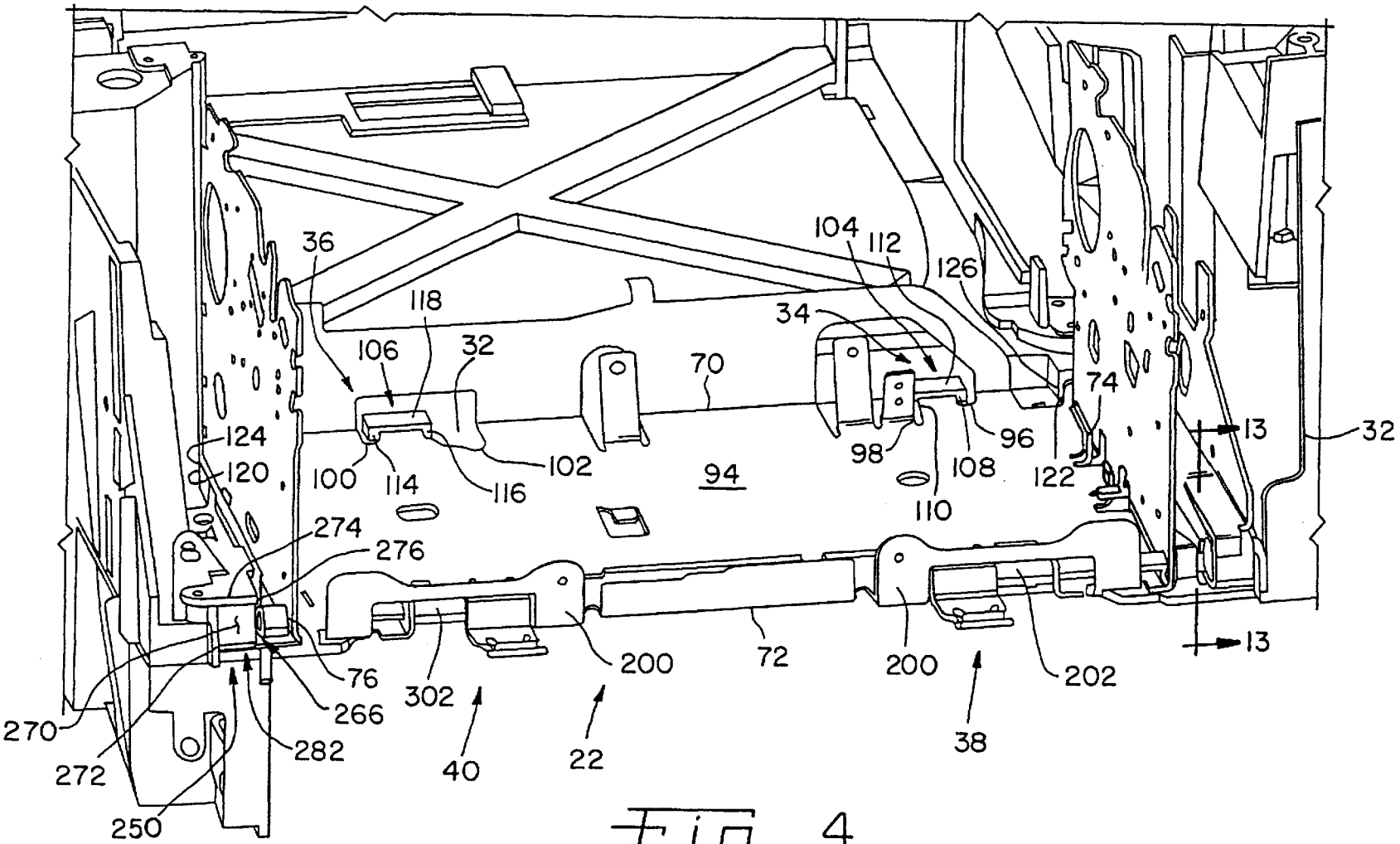
FIG. 4 is a perspective view of the fuser latch system components of the present invention.

Fuser assembly 20 includes a fuser unit 24 and an oil web unit 26. Fuser unit 24 has a fuser frame 28, including a hot roll cover 30. Fuser unit 24 is a customer replaceable unit (CRU), adapted for installation in and removal from a base machine having a base machine frame 32 (FIG. 4), being secured therein by latch system 22. Latch system 22 includes front holders 34 and 36 and rear latches 38 and 40, each to be described in greater detail herein after. FIG. 4 illustrates the relative relationships of the base machine components and the fuser unit components of each front holders 34 and 36 and rear latches 38 and 40.

Figure 2:
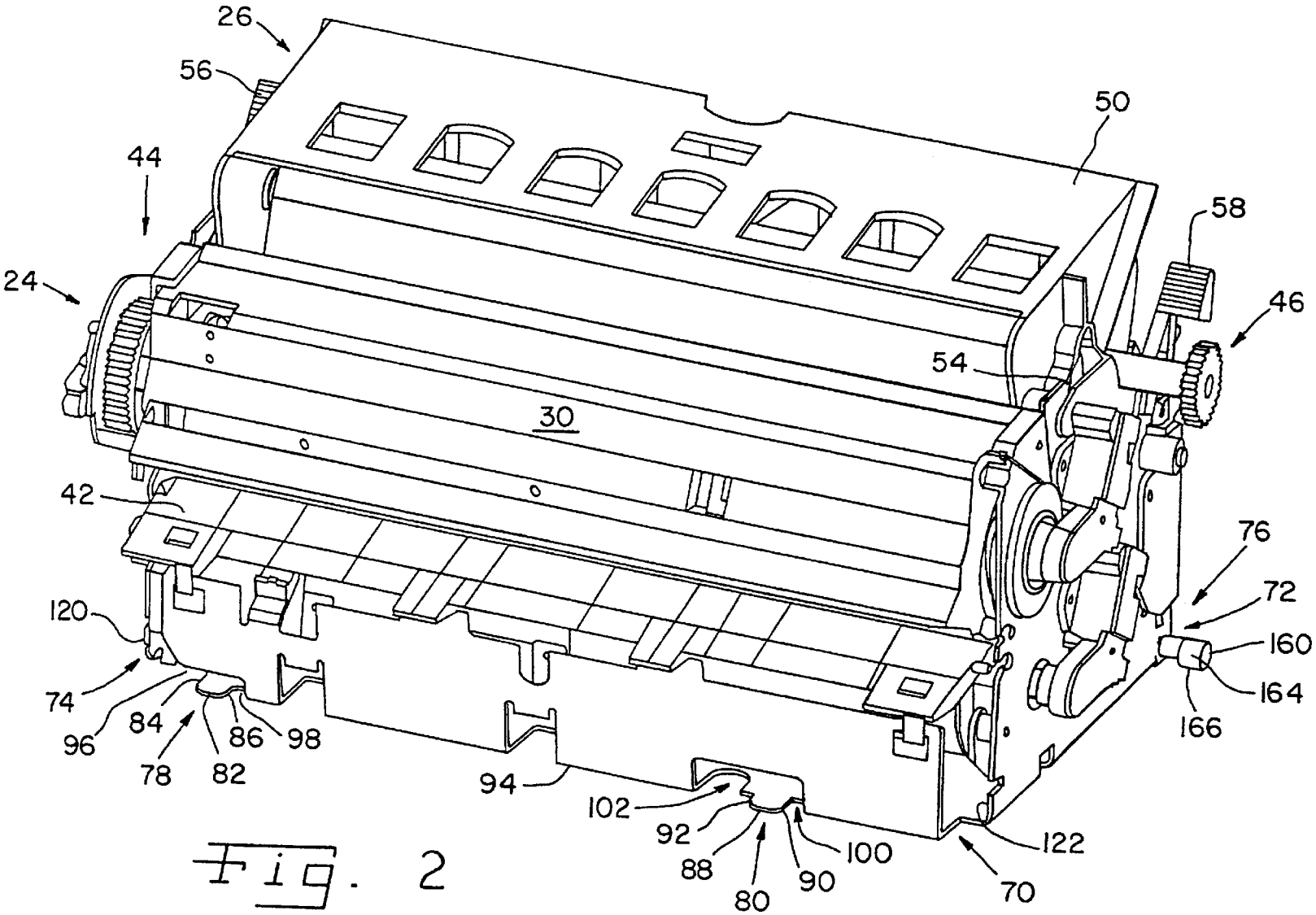
FIG. 2 is a perspective view of the fuser unit shown in FIG. 1, showing the side opposite the side shown in FIG. 1.
Figure 3:
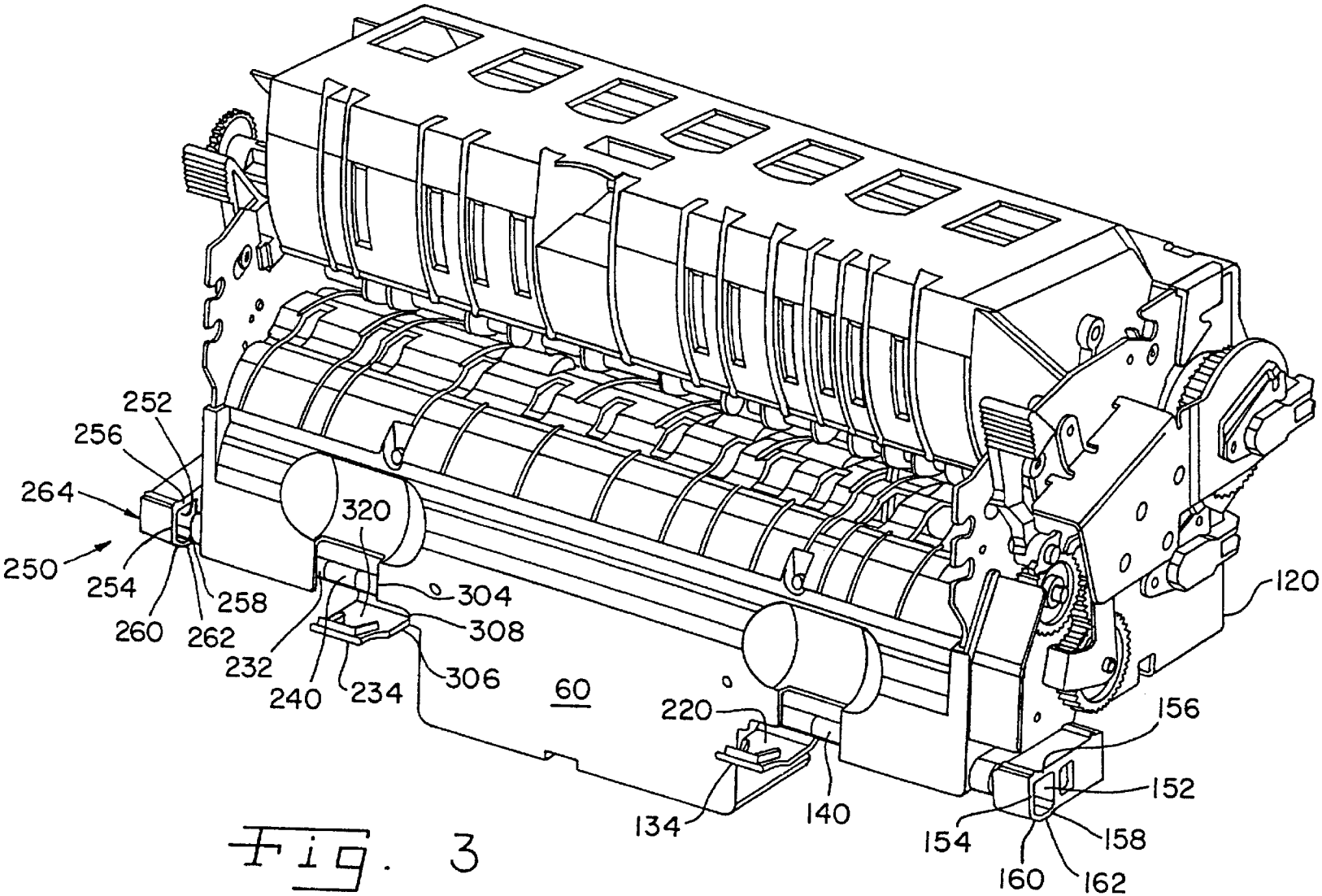
FIG. 3 is a perspective view, similar to FIG. 1, illustrating the fuser latch system in an unlocked position.

Paper or other printed media enters fuser unit 24 at ramp 42, seen most clearly in FIG. 2, and passes between a hot roll and a backup roll in fuser 20, wherein heat and pressure are applied for thermally setting toner particles on the media. Those skilled in the art will understand the operation of fuser unit 24, which is not relevant to an understanding of the present invention and will not be explained in further detail herein.

Gear trains 44 and 46, shown in FIGS. 1 and 2, are provided outside of fuser frame 28, and are used for driving the various rolls in fuser assembly 20, such as the hot roll, the backup roll and various other rotary elements, not shown. Each of gear trains 44 and 46 is a plurality of intermeshed gears connected to the various rolls of fuser assembly 20. The components of gear train 44 are primarily those for driving the various rolls in fuser unit 24 of fuser assembly 20, while the various components of gear train 46 are primarily those for driving the various rolls of oil web unit 26. A fuser gear 48 drivingly engages a pinion gear (not shown) in the base machine, and receives rotational power therefrom, which is then transmitted to the remaining components of gear train 44. Yet another gear train, not shown, in the base machine drives gear train 46.

Oil web unit 26 is secured to fuser unit 24, and includes an oil web housing 50. Oil web unit 26 is separately replaceable from fuser unit 24. Slots 52 and 54 in fuser frame 28 receive locator pins extending outwardly from oil web housing 50. Oil web unit 26 is further secured to fuser unit 24 by hooks 56 and 58 pivotally mounted to fuser frame 28 and adapted for engaging pins on oil web housing 50. Oil web unit 26 includes a web carrying a release agent for application on the hot roll of fuser unit 24. A supply spool of unused material and a take-up spool for used material are disposed in oil web unit 26. Additional guide rolls and devices are provided for directing the web material. Those skilled in the art will understand the operation of oil web unit 26, which is not relevant to an understanding of the present invention, and will not be explained in further detail herein.

A fuser frame cover 60 may be provided for safety and cosmetic purposes. It should be further understood that the external views of FIG. 1 and FIG. 2 have been simplified, with various other covers and guards not being shown. Further, numerous other elements such as electrical connections, lamps and lamp brackets and the like have not been shown, in that the operation thereof is readily understood by those skilled in the art and, further, an understanding thereof is not required for an understanding of the present invention.

Front holders 34 and 36 of fuser latch system 22 will now be described, with reference primarily to FIGS. 2 and 4. Fuser frame 28 includes a first or front side 70, a second or rear side 72, a first lateral side 74 and a second lateral side 76. Front side 70 includes datums 78 and 80. Each datum 78, 80 is an isolated, projecting body relative to the near portions of front side 70. Datum 78 has a front 82 and sides 84 and 86. Datum 80 has a front 88 and sides 90 and 92. While being described as isolated, projecting bodies, datums 78 and 80 need not project beyond front side 70. As shown in FIG. 2, fuser frame 28 includes a bottom 94, from which cutouts 96 and 98 have been made from front side 70, thereby forming datum 78 in bottom 94. Cutouts 100 and 102 have been similarly made in bottom 94 from front side 70, thereby forming datum 80 in bottom 94.

Base machine frame 32 includes datum receivers such as a pocket 104 for receiving therein datum 78, and a pocket 106 for receiving therein datum 80. Pocket 104 includes sides 108 and 110, and a top 112 extending there between. Pocket 106 includes sides 114 and 116, and a top 118 extending there between. At least one of pockets 104 and 106 is only minimally wider than the width of datum 78 or 80 with which it is associated, so as to receive datum 78 or 80 therein with minimal lateral movement permitted. Similarly, either or, preferably, both pockets 104 and 106 is only minimally taller than the heights of datums 78 and 80, to control vertical movement. Fronts 82 and 88 of datums 78 and 80 may be rounded or tapered to facilitate directing datums 78 and 80 for proper seating in pockets 104 and 106.

The critical front to back positioning of fuser unit 24 is controlled by a second set of datums 120, 122 provided on fuser frame 28, along front side 70 near first and second lateral sides 74 and 76, respectively. Datum reference surfaces 124 and 126 are provided on machine frame 32 as datum receivers. Fuser latch system 22 biases datums 120 and 122 against surfaces 124 and 126 to control front to back movement of fuser unit 24.

While two front holders 34 and 36, including four datums 78, 80, 120 and 122 and corresponding pockets 104 and 106 or surfaces 124 and 126 have been shown and described, it should be understood that one front holder, or more than two front holders with more or fewer datums also may be used. The size and shape of datums 78 and 80 may be changed, together with corresponding changes in the sizes and shapes of pockets 104 and 106 for receiving datums 78 and 80 as described.

Rear latches 38 and 40 are provided near first lateral side 74 and second lateral side 76, respectively, along rear side 72. Rear latch 38 includes a shaft 130 held in one or more mounting tabs 132 secured in fuser frame 28 so as to accommodate rotation of shaft 130 about the longitudinal axis thereof, and also to accommodate axial translation of shaft 130 relative to fuser frame 28. A handle 134 is attached to shaft 130, near an inner end of shaft 130, and may be used to cause both the axial rotation and translation of shaft 130. An outer end of shaft 130 includes an eccentric body 136 thereon, having a lobe 138. Eccentric body 136 is disposed outwardly of fuser frame 28. A spring 140 operatively disposed between handle 134 and one mounting tab 132 of frame 28 biases shaft 130 inwardly. Body 136 limits the inward travel of shaft 130, with an inner surface 142 of body 136 abutting a member of fuser frame 28.

A retainer 150 is secured in base machine frame 32, just outwardly of fuser unit 24, and includes structure configured and arranged for receiving eccentric body 136 therein. Retainer 150 includes a forward wall 152, a rearward wall 154 and a top 156. Angular wings 158 and 160 extend downwardly from forward wall 152 and rearward wall 154, respectively, joining a bottom 162. Retainer 150 thereby defines a space 164 having a lateral opening 166 (FIG. 7) on the inner side of retainer 150, through which body 136 is received.

Figure 6:
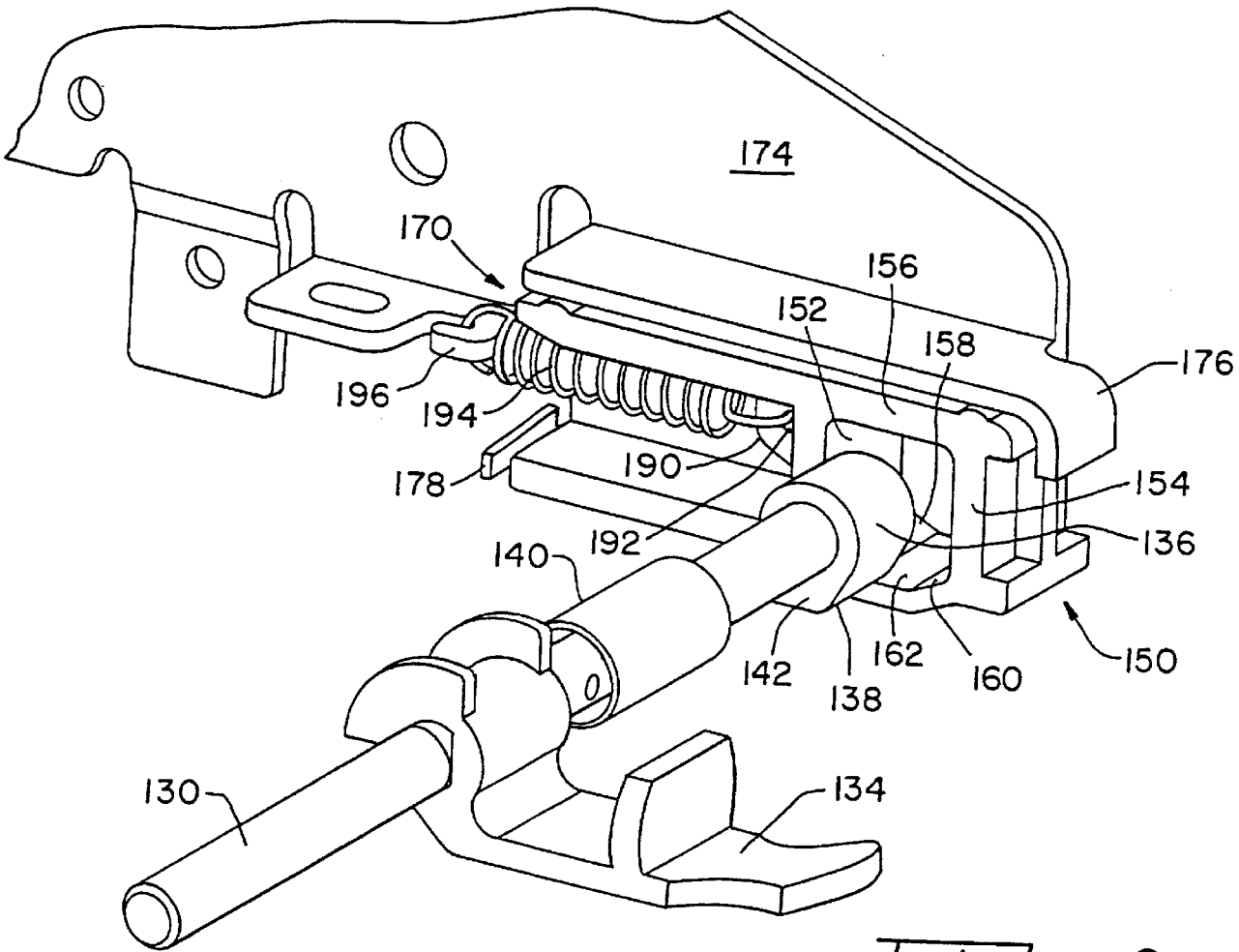
FIG. 6 is an enlarged perspective view of a rear latch for the fuser latch system, illustrating the fuser and base machine components in an unlatched position.
Figure 7:
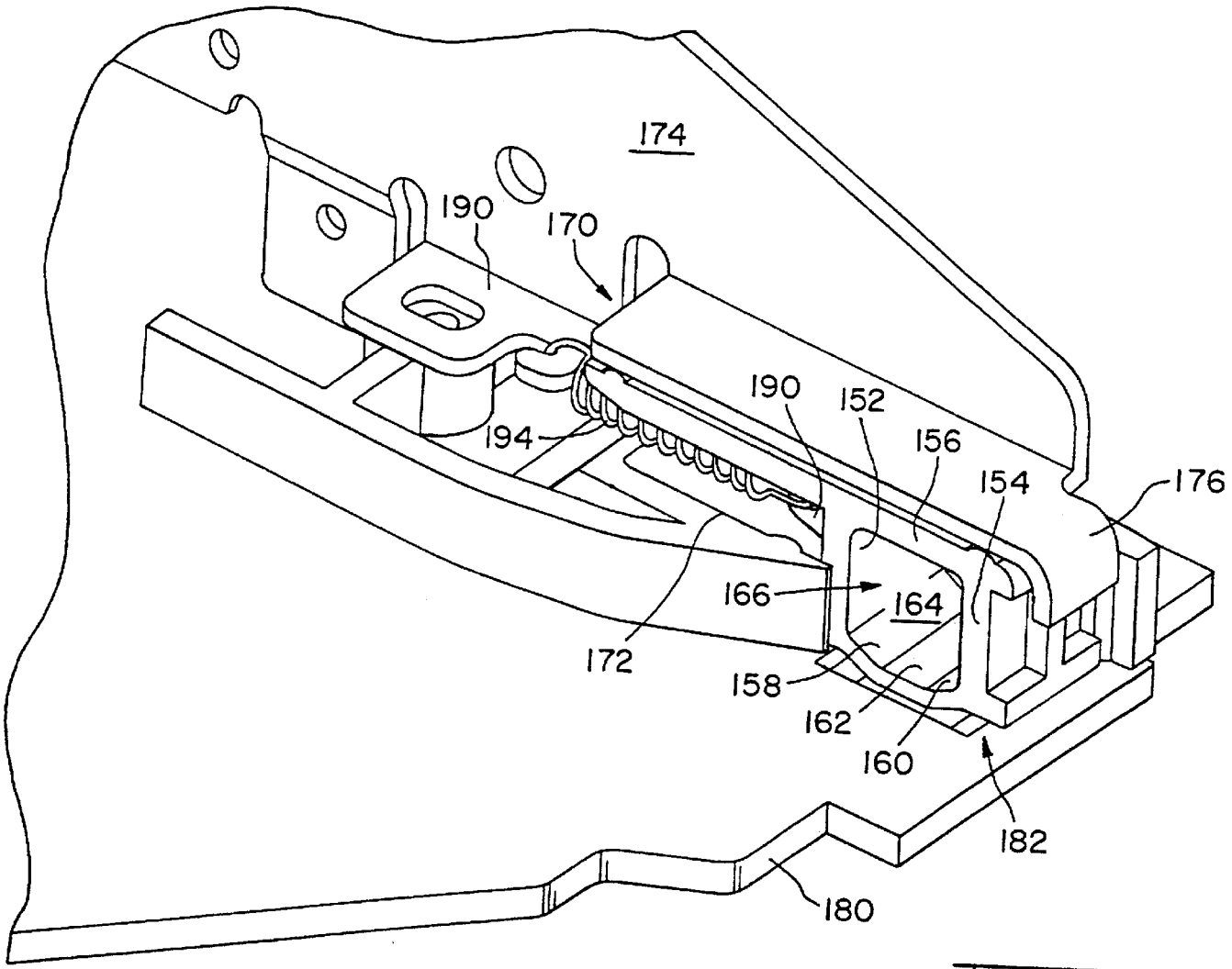
FIG. 7 is an enlarged perspective view of the base machine component of a rear latch for the fuser latch system.
Figure 9:
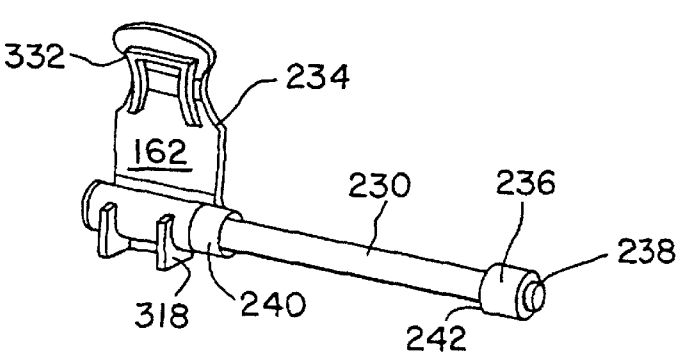
FIG. 9 is a perspective view of a fuser component for a left rear latch.

A preferred assembly for retainer 150 is shown in FIGS. 6 and 7. Retainer 150 is formed as a rearward portion of a sliding member 170. Base machine frame 32 forms a channel 172 in which sliding member 170 is disposed. Sliding member 170 is freely floating in the channel 172. A hold down element 174 is fixedly coupled to a portion of base machine frame 32, and includes a down turned lip 176. Hold down element 174 confines sliding member 170 from the top thereof, and down turned lip 176 prevents excessive movement of sliding member 170 in the direction thereof, such as during a drop event. A forward stop 178 similarly prevents excessive movement of sliding member 170 in the direction thereof. A floor 180 of base machine frame 32 defines a trough 182 for receiving and engaging a downward projection of sliding member 170 formed by angular wings 158 and 160, and bottom 162.

Sliding member 170 includes a protrusion 190 having an aperture 192 therein for receiving an end of an extension spring 194. The opposite end of spring 194 is connected to a hook-like projection 196 of hold down element 174. Spring 194 biases sliding member 170 against forward stop 178.

Figure 5:
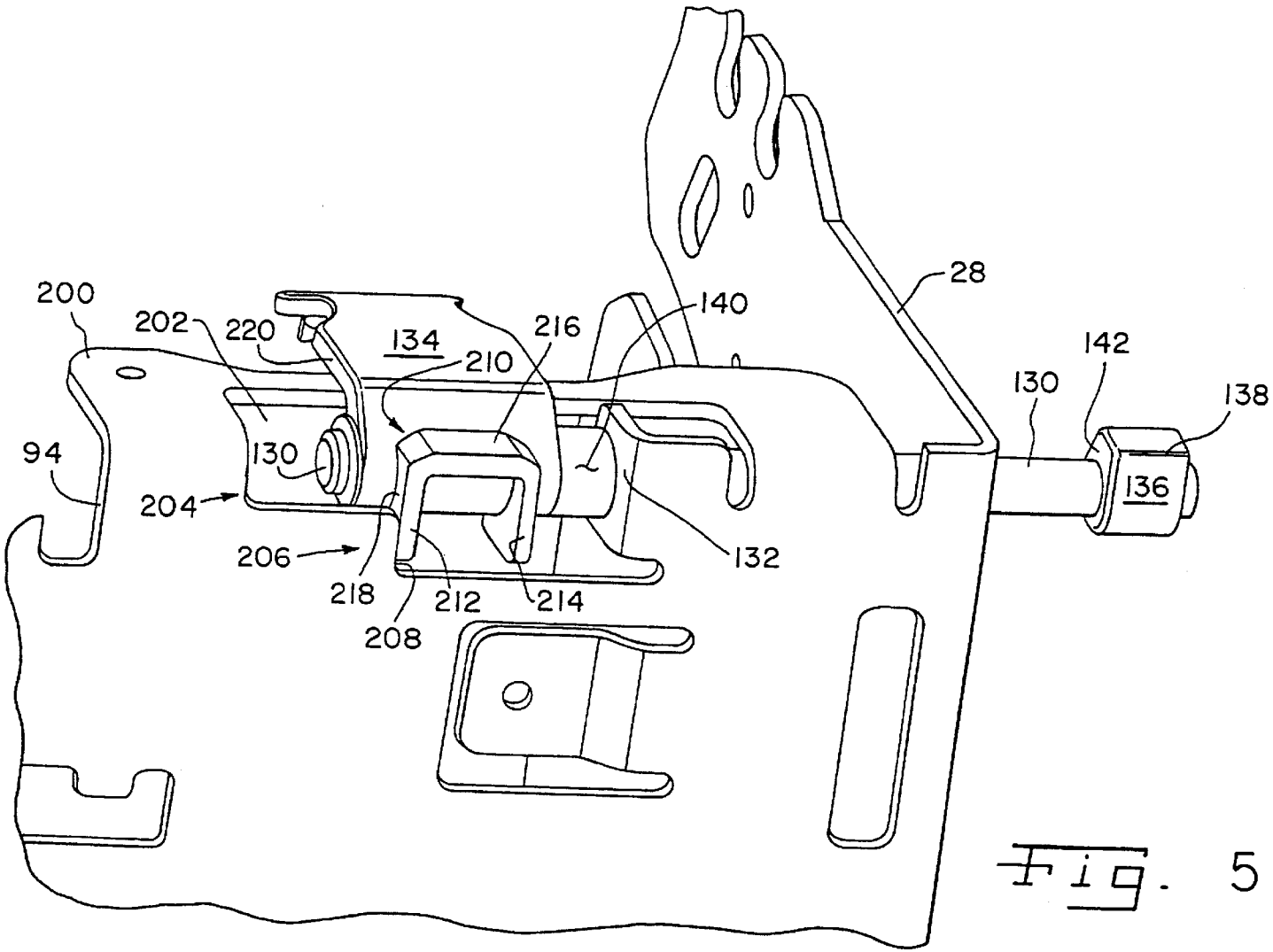
FIG. 5 is an enlarged perspective view of a rear latch of the fuser latch system in the locked position.

Fuser frame 28 includes a rear wall 200, which, as shown in FIG. 4, may include separate sections extending upwardly from bottom 94 near rear latches 38 and 40. A cutout 202 defines openings in portions of bottom 94 and rear wall 200 for accommodating movement of handle 134 during both rotation and translation of shaft 130. As seen most clearly in FIG. 5, cutout 202 has a shallow segment 204 along an inward portion of the cutout in bottom 94, and a deeper segment 206 along an outward portion thereof. A wall 208 is defined between shallow segment 204 and deeper segment 206. Handle 134 includes a bracket 210 along a lower portion thereof, bracket 210 including sides 212 and 214 and a back 216. When handle 134 is positioned in the locked position, that is with handle 134 rotated fully upward, and shaft 130 translated axially outwardly, as shown in FIG. 5, an outer surface 218 of side 212 is engaged against wall 208, and is urged there against by spring 140. A front surface 220 of handle 134 is disposed near or against rear wall 200.

Rear latch 40 is similarly constructed to rear latch 38, being substantially a mirror image thereof. Rear latch 40 includes a shaft 230 held in one or more mounting tabs 232 secured in fuser frame 28 so as to accommodate rotation of shaft 230 about the longitudinal axis thereof, and also to accommodate axial translation of shaft 230 relative to fuser frame 28. A handle 234 is attached to shaft 230, near an inner end of shaft 230, and may be used to cause both the axial rotation and translation of shaft 230. An outer end of shaft 230 includes an eccentric body 236 thereon, having a lobe 238. Eccentric body 236 is disposed outwardly of fuser frame 28. A spring 240 operatively disposed between handle 234 and one mounting tab 232 of frame 28 biases shaft 230 inwardly. Body 236 limits the inward travel of shaft 230, with an inner surface 242 of body 236 abutting a member of fuser frame 28.

A retainer 250 is secured in base machine frame 32, just outwardly of fuser unit 24, and includes structure configured and arranged for receiving eccentric body 236 therein. Retainer 250 includes a forward wall 252, a rearward wall 254 and a top 256. Angular wings 258 and 260 extend downwardly from forward wall 252 and rearward wall 254, respectively, joining a bottom 262. Retainer 250 thereby defines a space 264 having a lateral opening 266 on the inner side of retainer 250, through which body 236 is received.

The preferred assembly for retainer 250 is similar to that shown and described for retainer 150. Retainer 250 is formed as a rearward portion of a sliding member 270. Base machine frame 32 forms a channel 272 in which sliding member 270 is disposed. Sliding member 270 is freely floating in the channel 272. A hold down element 274 is fixedly coupled to a portion of base machine frame 32, and includes a down turned lip 276. Hold down element 274 confines sliding member 270 from the top thereof, and down turned lip 276 prevents excessive movement of sliding member 270 in the direction thereof, such as during a drop event. An optional forward stop (not shown) similarly prevents excessive movement of sliding member 270 in the direction thereof Floor 180 of base machine frame 32 defines a trough 282 for receiving and engaging a downward projection of sliding member 270 formed by angular wings 258 and 260, and bottom 262.

Figure 12:
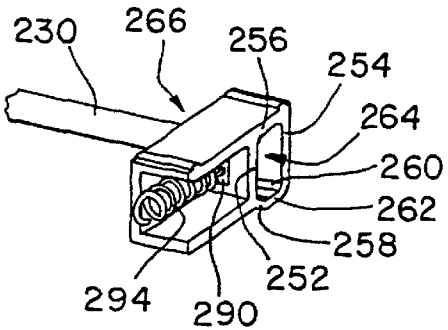
FIG. 12 is a perspective view of a base machine component for a left rear latch.
Figure 11:
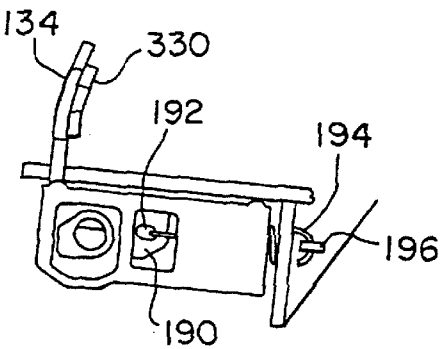
FIG. 11 is an end view similar to that of FIG. 10 but illustrating the rear latch in a locked position.
Figure 8:
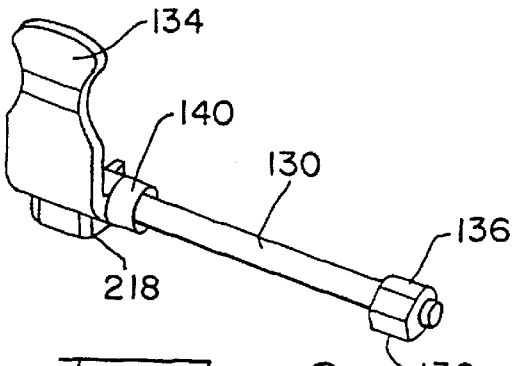
FIG. 8 is a perspective view of a fuser component for a right rear latch.
Figure 10:
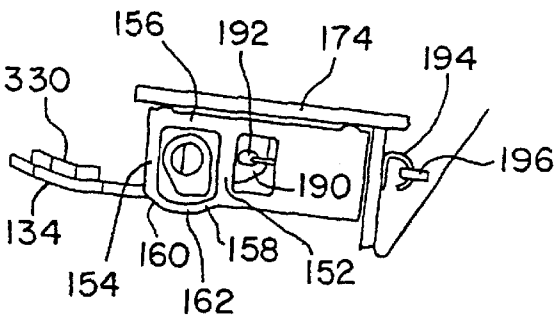
FIG. 10 is an end view of the fuser unit and base machine components of a rear latch in the unlocked position.
Figure 13:
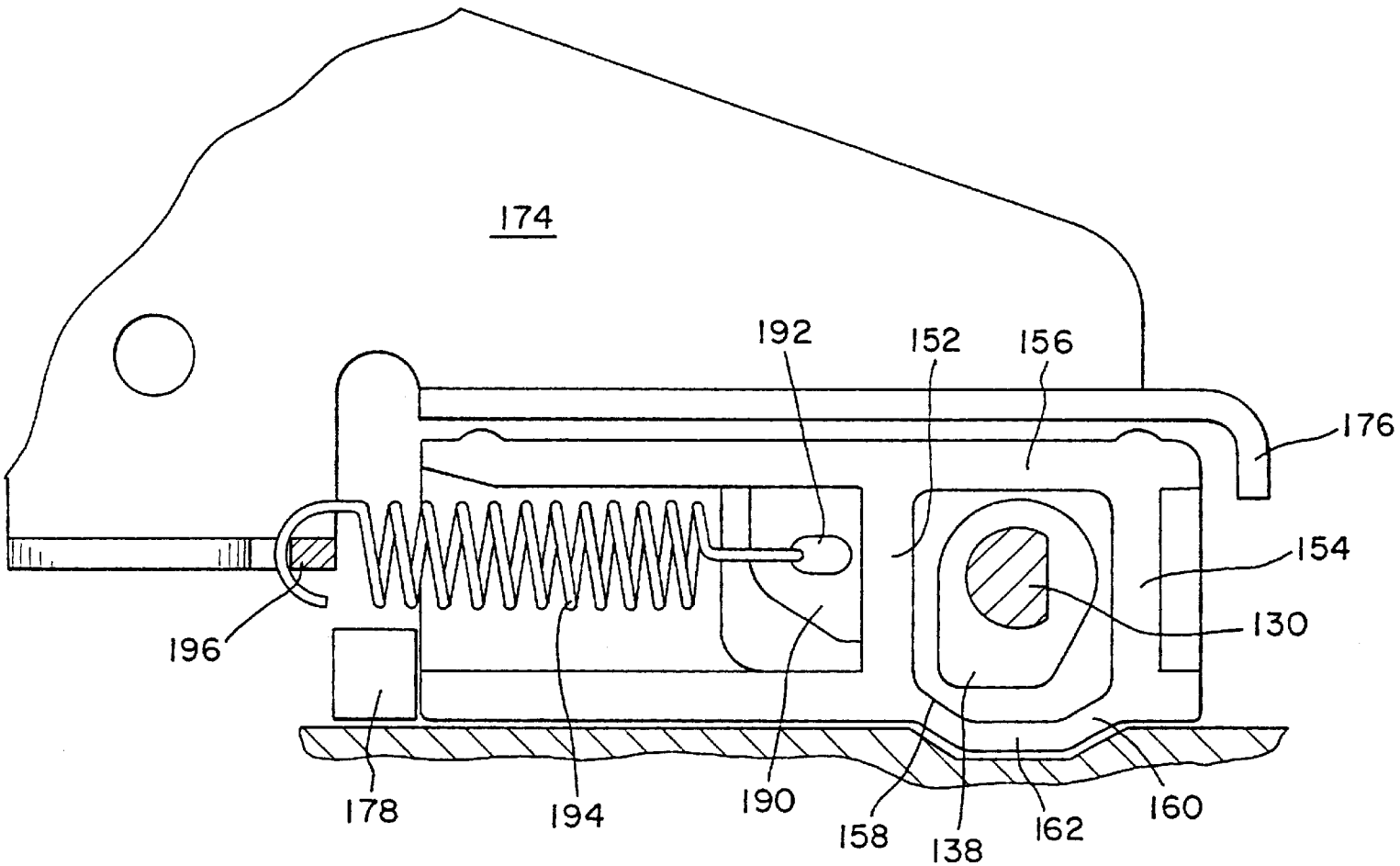
FIG. 13 is an enlarged cross-sectional view of the rear latch shown in FIG. 4, taken along line 13—13 of FIG. 4.
Figure 14:
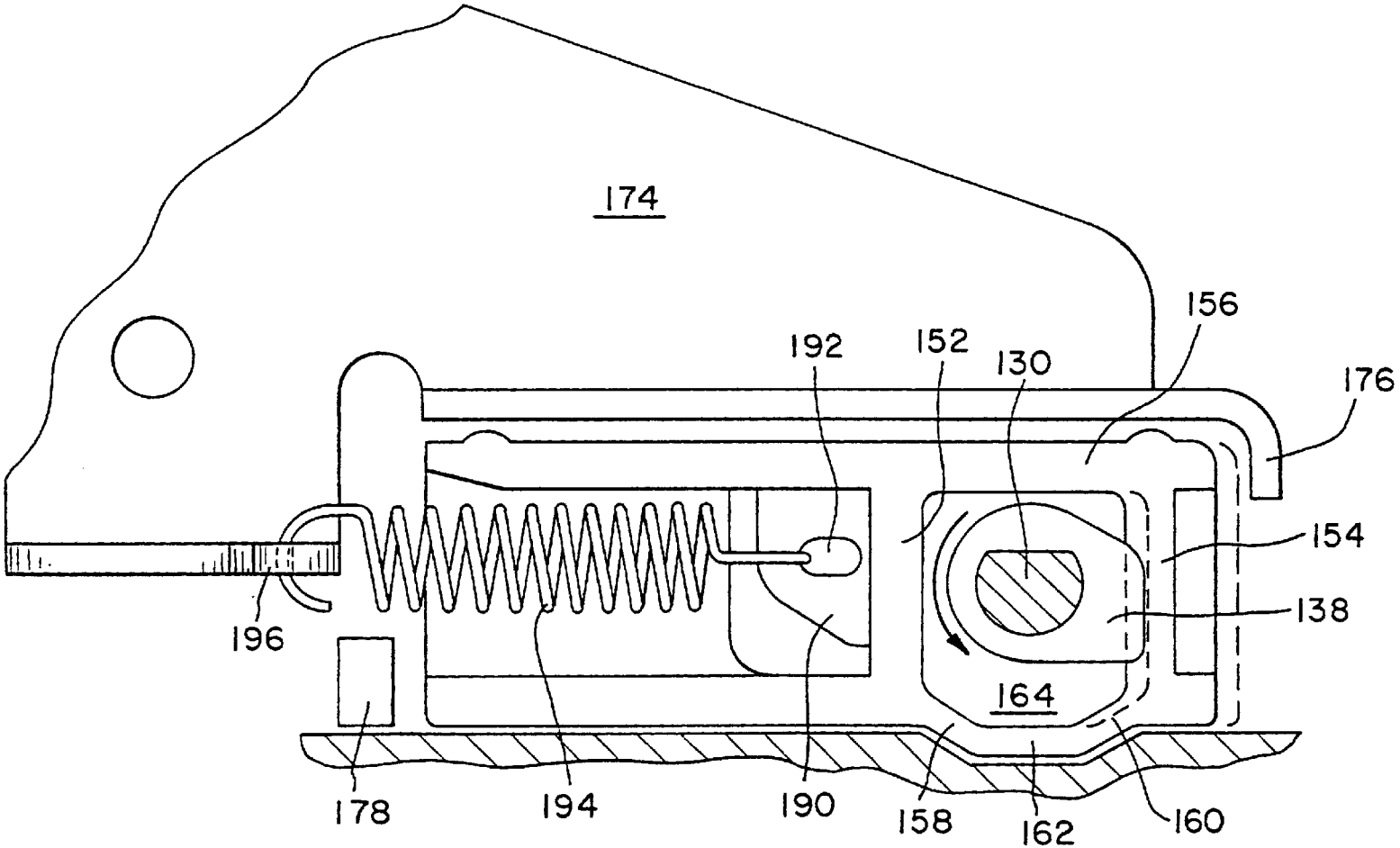
FIG. 14 is an elevational view similar to FIG. 13, but illustrating the rear latch in the locked position.

Sliding member 270 includes a protrusion 290 (FIG. 12) having an aperture therein for receiving an end of an extension spring 294, the opposite end of which is connected to hold down element 274. The spring biases sliding member 270 against the forward stop.

A cutout 302 defines openings in portions of bottom 94 and rear wall 200 for accommodating movement of handle 234 during both rotation and translation of shaft 130. As seen most clearly in FIG. 5, cutout 302 has a shallow segment 304 along an inward portion of the cutout in bottom 94, and a deeper segment 306 along an outward portion thereof. A wall 308 is defined between shallow segment 304 and deeper segment 306. Handle 234 includes a bracket 310 along a lower portion thereof, bracket 310 including sides 312 and 314 and a back 316. When handle 234 is positioned in the locked position, that is with handle 234 rotated fully upward, and shaft 230 translated axially outwardly, as shown in FIG. 5, an outer surface 318 of side 312 is engaged against wall 308, and is urged there against by spring 240. A front surface 320 of handle 234 is disposed near or against rear wall 200.

If an existing fuser unit 24 is to be replaced, the installed unit is removed by moving handles 134 and 234 from the vertical, locked position illustrated in FIG. 1 to the horizontal, unlocked position illustrated in FIG. 4. Handles 134 and 234 are urged inwardly by springs 140 and 240, respectively. With respect to the movement of handle 134, as handle 134 is moved downwardly, shaft 130 is rotated. Lobe 138 of eccentric body 136 is rotated from the essentially rearwardly directed position illustrated in FIG. 5, wherein lobe 138 is engaged against rearward wall 154, to the substantially downwardly directed position illustrated in FIG. 6. Eccentric body 136 becomes freely slidable in space 164 of retainer 150. Simultaneously, bracket 210 is rotated such that outer surface 218 of side 212, which is urged against wall 208 by spring 140, slides against wall 208 until entire side 212 and back 216 clear wall 208. At such point, no interference exits between bracket 212 and cutout 202, thereby allowing spring 140 to urge shaft 130 inwardly, and removing eccentric body 136 from retainer 150. Unlocking rear latch 140 operates similarly, with spring 240 moving shaft 230 inwardly, thereby extracting eccentric body 236 from retainer 250. Fuser unit 24 can then be removed from base machine frame 32 by grasping fuser unit 24 and pulling fuser unit 24 rearwardly by latches 134 and 234. As fuser unit 24 is moved rearwardly, datums 78 and 80 are removed from pockets 104 and 106, and datums 120 and 122 are removed from against surfaces 124 and 126, respectively. The old fuser unit 24 can then be removed fully from the base machine frame.

To insert a new, replacement fuser unit 24 into base machine frame 32, rear latches 38 and 40 are placed in the unlocked position illustrated in FIG. 4. Fuser unit 24 is positioned and slid into the machine until datums 78 and 80 are seated in pockets 104 and 106 and datums 120 and 122 are against surfaces 124 and 126. Each of handles 134 and 234 is moved outwardly, thereby axially translating shafts 130 and 230. Eccentric bodies 136 and 236 are thereby moved into retainers 150 and 250, respectively. Lobes 138 and 238 are in the downwardly directed position, received in paces 164 and 264, respectively. Each of handles 134 and 234 is rotated upwardly. As eccentric bodies 136 and 236 are rotated, lobes 138 and 238 rotate rearwardly, and engaging against rearward walls 154 and 254. Through the operation of sliding members 170 and 270 in channels 172 and 272, respectively, spring 194 and a similar spring, not shown, connected between sliding member 270 and base machine frame 32, apply force between fuser frame 28 and hold down element 174. Rotation of handles 134 and 234 simultaneously rotates brackets 216 and 316 such that surfaces 218 and 318 of sides 212 and 312, respectively, engage against walls 208 and 308 of cutouts 202 and 302, respectively. In this way, handles 134 and 234 can be secured in a locked position.

The shapes of eccentric bodies 136 and 236 and rearward walls 154 and 254 can be such that rear latches 38 and 40 are stabilized in the locked position, with significant but appropriate force required to rotate eccentric bodies 136 and 236 out of the locked position. Further, an outer access door of the printer or other machine in which fuser assembly 20 is installed can force handles 134 and 234 to remain in the vertical, locked position when the door is closed. Any of the aforedescribed or other locking means may be used to secure handles 134 and 234 in the locked position.

The spring force exerted by spring 194 and the corresponding spring, not shown, in retainer 250, urges datums 120 and 122 against surfaces 124 and 126, such that the various gears of fuser assembly 20 are properly engaged with the gears provided in base machine frame 32. Gear mesh is controlled between the gears of fuser unit 24 and gears of the base machine. Fuser assembly 20 will also be properly positioned relative to the paper feed path for reliable paper feed through fuser assembly 20. Premature wear of gears mating between fuser assembly 20 and the base machine, as well as paper jams from paper misfeeding into fuser assembly 20 from the base machine paper path are substantially reduced.

The spring actuated arrangement of sliding members 170 and 270 in channels 172 and 272 of retainers 150 and 250, respectively, is a preferred structure. However, it should be realized that by manufacturing eccentric bodies 136 and 236 to tight tolerances and precisely locating fixed retainers similar to retainers 150 and 250 in the base machine, it is possible to achieve the same advantages as the resilient, spring loaded structure. For further resiliency, eccentric bodies 136 and 236 may be manufactured of a thermal plastic elastomer or a rubber material. Also, a hooking mechanism may be provided on handles 134 and 234, to secure the handles in the locked position. Detents may be provided on front surfaces 220 and 320 of handles 134 and 234, respectively, with each detent engaging an edge of an opening formed in rear wall 200, when the handles are in the fully locked position. To even more positively secure handles 134 and 234 in the vertically locked position, such detents can be provided on bodies 330 and 332 slidable on front surfaces 220 and 320 of handles 134 and 234, respectively. Unlocking then requires vertical movement of the bodies, to disengage the detents from edges of outer wall 200 to which the detents are secured.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A latch system for securing a fuser unit in a base machine, said latch system comprising:

a datum receiver provided on said base machine;

a retainer connected to said base machine, said retainer having walls defining an enclosed space and a lateral opening to said enclosed space;

a frame for said fuser unit, said frame having a plurality of sides;

a datum on said frame, said datum configured to engage said datum receiver;

a shaft connected to said frame, said shaft being axially rotatable and axially translatable relative to said frame;

an end of said shaft adapted to be received in said enclosed space upon axial translation of said shaft, said end of said shaft adapted to engage a wall of said walls upon rotation of said shaft; and a handle connected to said shaft and movable between locked and unlocked positions upon rotation of said shaft, said handle having locking means for securing said handle in said locked position.

2. The latch system of claim 1, said datum receiver disposed on a first side of said frame, and said shaft mounted on a second side of said frame opposite said first side.

3. The latch system of claim 2, including a lobe on said end of said shaft, said lobe operating in said enclosed space to urge said datum into engagement with said datum receiver upon rotation of said shaft.

4. The latch system of claim 3, including a spring urging said shaft away from said retainer.

5. The latch system of claim 3, including a channel defined in said base machine, a sliding member disposed in said channel, said sliding member including said retainer, and a spring urging said sliding member toward said datum receiver.

6. The latch system of claim 1, including a lobe on said end of said shaft, said lobe operating in said enclosed space to urge said datum into engagement with said datum receiver upon rotation of said shaft.

7. The latch system of claim 6, including a spring urging said shaft away from said retainer.

8. The latch system of claim 7, including a channel defined in said base machine, a sliding member disposed in said channel, said sliding member including said retainer, and a spring urging said sliding member toward said datum receiver.

9. The latch system of claim 1, including a spring urging said shaft away from said retainer.

10. The latch system of claim 9, including a channel defined in said base machine, a sliding member disposed in said channel, said sliding member including said retainer, and a spring urging said sliding member toward said datum receiver.

11. The latch system of claim 1, including a channel defined in said base machine, a sliding member disposed in said channel, said sliding member including said retainer, and a spring urging said sliding member toward said datum receiver.

12. The latch system of claim 1, including a plurality of said retainers, at least one retainer of said plurality of retainers disposed on one side of said frame and at least a second retainer of said plurality of retainers disposed on a second side of said frame opposite said first side of said frame; and a plurality of said shafts connected to said frame, one shaft of said plurality of shafts adapted to be received in said first retainer, and a second shaft of said plurality of shafts adapted to be received in said second retainer.

13. The latch system of claim 12, including a plurality of said datum receivers provided on said base machine and a plurality of said datums on said frame, each said datum configured to be received by a datum receiver of said plurality of datum receivers.

14. A latch system for securing a fuser unit in a base machine, said latch system comprising:

a frame carrying said fuser unit, said frame having a front side, a rear side and first and second lateral sides;

a first retainer connected to said base machine near said first lateral side of said frame, said first retainer having a plurality of walls defining a first enclosed space and a lateral opening to said enclosed space;

a second retainer connected to said base machine near said second lateral side, said second retainer having a second enclosed space with a lateral opening thereto;

each said first retainer and said second retainer being near said rear side;

a first shaft connected to said frame near said first lateral side and a second shaft connected to said frame near said second lateral side, each said first shaft and said second shaft being rotatable and axially translatable relative to said frame;

an end of said first shaft adapted to be received in said first enclosed space by axial translation of said first shaft;

an end of said second shaft adapted to be received in said second enclosed space by axial translation of said second shaft;

a first handle connected to said first shaft and movable between locked and unlocked positions, said first handle having first locking means for securing said first handle in said locked position; and a second handle connected to said second shaft and movable between locked and unlocked positions, said second handle having second locking means for securing said second handle in said locked position.

15. The latch system of claim 14, including a mounting datum on said front said of said frame, said first shaft and said second shaft mounted on said rear side of said frame, and a datum receiver in said base machine for engaging said mounting datum.

16. The latch system of claim 15, including a plurality of mounting datums on said front side of said frame, and a plurality of datum receivers in said base machine for engaging said plurality of mounting datums.

17. The latch system of claim 16, including a first lobe on said first end of said first shaft and a second lobe on said second end of said second shaft, said first lobe operating in said first enclosed space upon rotation of said first shaft and said second lobe operating in said second enclosed space upon rotation of said second shaft to urge said plurality of datums into engagement with said plurality of datum receivers.

18. The latch system of claim 14, including a first spring urging said first shaft away from said first enclosed space and a second spring urging said second shaft away from said second enclosed space.

19. The latch system of claim 14, including a first sliding member having walls defining said first enclosed space, a first retainer spring urging said first sliding member toward said front side, a second sliding member having walls defining said second enclosed space, and a second retainer spring urging said second sliding member toward said front side.

20. The latch system of claim 14, said first and second locking means including first and second brackets having surfaces urged against said frame.

21. A latch system for a fuser unit in a base machine, comprising:

a frame for said fuser unit, said frame having a front side, a rear side and first and second lateral sides;

mounting datums on said front side of said frame for securing said front side of said fuser unit, datum receivers in said base machine engaging said datums and releasing said datums by movement of said frame;

a first latch mechanism and a second latch mechanism disposed at said rear side of said frame, said first latch mechanism disposed near said first lateral, side, of said frame and said second latch mechanism disposed near said second lateral side of said frame;

said first latch mechanism having a first eccentric body and said second latch mechanism having a second eccentric body; and a first retainer and a second retainer in said base machine configured and arranged for receiving said first eccentric body and said second eccentric body, respectively.

22. The latch system of claim 21, said first eccentric body and said second eccentric body having a first lobe and a second lobe, respectively, said first lobe operable in said first retainer and said second lobe being operable in said second retainer, each said first lobe and said second lobe operable upon relative rotation thereof to urge said datums into engagement with said datum receivers.

23. The latch system of claim 22, including a first spring and a second spring urging, respectively, said first body away from said first retainer and said second body away from said second retainer.

24. The latch system of claim 21, including first and second retainer springs interconnecting said first and second retainers and said base machine, said first and second retainer springs and urging said first and second retainers toward said datum receivers.

25. A method for securing a fuser in a base machine comprising:

providing datums on a forward side of said fuser;

providing datum receivers in said base machine for engaging said datums;

sliding said fuser and engaging said datums in with said receivers;

providing a first latch mechanism and a second latch mechanism, each having a fuser component and a base machine component;

sliding said fuser components of said first latch mechanism and said second latch mechanism each axially outwardly;

inserting said fuser components into said base machine components; and rotating said fuser components in said base machine components.

26. A latch system for securing a first frame in a second frame, said latch system comprising:

a holder having a datum on one of said frames and a datum receiver on the other of said frames, said datum and said receiver configured and arranged for said receiver to engage said datum by sliding one of said datum and said receiver toward the other;

a latch having a retainer on one of said frames and an axially translatable shaft on the other of said frames, said shaft having a body receivable in said retainer; and said holder and said latch disposed on opposite sides of said frames.

27. The latch system of claim 26, including means associated with said latch urging said datum into engagement with said receiver.

28. The latch system of claim 26, including two holders, each said holder having a datum on one of said frames and a datum receiver on the other of said frames, said datums and said receivers configured and arranged for said receivers to engage said datums by sliding one of said frames toward the other of said frames.

29. The latch system of claim 28, including two latches, each said latch having a retainer on one of said frames and an axially translatable shaft on the other of said frames, said shafts each having a body receivable in said retainers.

30. The latch system of claim 26, including two latches, each said latch having a retainer on one of said frames and an axially translatable shaft on the other of said frames, said shafts each having a body receivable in said retainers.

* * * * *